US009616983B2

(12) United States Patent
Mimlitch, III et al.

(10) Patent No.: US 9,616,983 B2
(45) **Date of Patent: *Apr. 11, 2017**

(54) VIBRATION-POWERED FLOATING OBJECT

(71) Applicant: Innovation First, Inc., Greenville, TX (US)

(72) Inventors: Robert H. Mimlitch, III, Rowlett, TX (US); David Anthony Norman, Greenville, TX (US); Joel Reagan Carter, Argyle, TX (US); Robert H. Mimlitch, Jr., West Tawakoni, TX (US); Douglas Michael Galletti, Allen, TX (US); Gregory E. Needel, Dallas, TX (US); Paul David Copioli, Rockwall, TX (US)

( * ) Notice: Subject to any disclaimer, the term of this patent is extended or adjusted under 35 U.S.C. 154(b) by 74 days.

This patent is subject to a terminal disclaimer.

(21) Appl. No.: 14/838,399

(22) Filed: Aug. 28, 2015

(65) Prior Publication Data

US 2016/0009348 A1 Jan. 14, 2016

Related U.S. Application Data

(63) Continuation of application No. 13/443,178, filed on Apr. 10, 2012, now Pat. No. 9,149,731.
(Continued)

(51) Int. Cl.
*A63H 23/00* (2006.01)
*A63H 23/10* (2006.01)
(Continued)

(52) U.S. Cl.
CPC ..... *B63H 1/30* (2013.01); *A63H 23/00* (2013.01); *A63H 23/04* (2013.01); *A63H 23/10* (2013.01); *A63H 23/14* (2013.01); *A63H 29/22* (2013.01)

(58) Field of Classification Search
CPC ..... A63H 23/00; A63H 23/08; A63H 23/10; A63H 23/12; A63H 23/14; A63H 23/16;
(Continued)

(56) References Cited

U.S. PATENT DOCUMENTS 1,697,043 A 1/1920 Brun
2,854,787 A 10/1958 Oberg
(Continued)

FOREIGN PATENT DOCUMENTS

GB 2243088 10/1991
KR 101033834 12/2010

*Primary Examiner* — Ajay Vasudeva
(74) *Attorney, Agent, or Firm* — Adam K. Sacharoff; Much Shelist

(57) ABSTRACT

A vibration-powered device adapted for flotation and propulsion on an upper surface in a liquid. The device having a body with a top side adapted to be at least partially disposed above the surface of the liquid, and a bottom side adapted to be at least partially submerged below the surface of the liquid. A vibration mechanism is disposed in the body. A propulsion fin is connected to the body. The fin includes a top side adapted to be disposed at least partially above the liquid surface, a bottom side adapted to be disposed at least partially below the surface. The vibration mechanism is adapted to oscillate the free distal end of the propulsion fin upward and downward.

20 Claims, 12 Drawing Sheets

Related U.S. Application Data

(60) Provisional application No. 61/474,483, filed on Apr. 12, 2011.

(51) Int. Cl.

| | |
|---|---|
| ***B63H 1/30*** | (2006.01) |
| ***A63H 23/04*** | (2006.01) |
| ***A63H 23/14*** | (2006.01) |
| ***A63H 29/22*** | (2006.01) |

(58) Field of Classification Search

CPC . A63H 29/22; B63H 1/30; B63H 1/32; B63H 1/36; B63H 1/37

USPC ..... 440/13–20; 446/156–158, 162–164

See application file for complete search history.

(56) References Cited

U.S. PATENT DOCUMENTS

| | | | | |
|---|---|---|---|---|
| 3,729,863 | A | 5/1973 | Asano | |
| 4,073,983 | A | 2/1978 | Van Cleave | |
| 4,135,326 | A | 1/1979 | Tong | |
| 4,345,903 | A | 8/1982 | Laser | |
| 4,687,456 | A | 8/1987 | Wang | |
| 4,713,037 | A | 12/1987 | Tong | |
| 5,088,949 | A | 2/1992 | Atkinson et al. | |
| 5,221,226 | A | 6/1993 | Park | |
| 5,993,286 | A | 11/1999 | Tacquard et al. | |
| 8,038,503 | B2 | 10/2011 | Norman et al. | |
| 8,684,777 | B2 | 4/2014 | Jemt | |
| 9,149,731 | B2 * | 10/2015 | Mimlitch, III ..... | A63H 23/04 |

* cited by examiner

VIBRATION-POWERED FLOATING OBJECT

CROSS-REFERENCE TO RELATED APPLICATION

This application claims is a Continuation application of U.S. patent application Ser. No. 13/443,178 entitled "Vibration-Powered Floating Object," filed on Apr. 10, 2012, now U.S. Pat. No. 9,149,731, which claims the benefit of U.S. Patent Application No. 61/474,483 entitled "Vibration-Powered Floating Object," filed on Apr. 12, 2011, both of which are incorporated herein by reference in their entirety.

BACKGROUND OF THE INVENTION

This application relates to a floating object powered by a vibration mechanism and a method for propulsion of a floating object, in particular, a vibration-powered object adapted for flotation and propulsion of the object on an upper surface in a body of liquid.

Adhesion and viscosity are two properties which are known to be possessed by all fluids. If you put a drop of water on a metal plate the drop will roll off; however, a certain amount of the water will remain on the plate until it evaporates or is removed by some absorptive means. The metal does not absorb any of the water, but the water adheres to it. The drop of water may change its shape, but until its particles are separated by some external power it remains intact. This tendency of all fluids to resist molecular separation is viscosity.

It is these properties of adhesion and viscosity that cause the "skin friction" that impedes a ship in its progress through the water or an airplane going through the air. All fluids have these qualities.

A meniscus (plural: menisci, from the Greek for "crescent") is the curve in the upper surface of a standing body of liquid, produced in response to the surface of the container or another object. It can be either convex or concave. A convex meniscus occurs when the molecules have a stronger attraction to each other (cohesion) than to the container (adhesion). This may be seen between mercury and glass in barometers. Conversely, a concave meniscus occurs when the molecules of the liquid attract those of the container. This can be seen between water and an unfilled glass. One can over-fill a glass with water, producing a convex meniscus that rises above the top of the glass, due to surface tension.

SUMMARY OF THE INVENTION

The present disclosure illustrates and describes a vibration-powered object adapted for flotation and propulsion of the object on an upper surface in a body of liquid. By way of example, and not by way of limitation, such an object may be a child's toy.

Movement of the object in the liquid can be accomplished by oscillation of a propulsion fin induced by the motion of a vibration mechanism inside of, or attached to, the object. The vibration mechanism can include a motor rotating a weight with a center of mass that is offset relative to the rotational axis of the motor. The rotational movement of the weight causes the rotational motor (also referred to herein as a "vibration mechanism"), and the object to which it is attached, to vibrate. The vibration of the object induces oscillations in the propulsion fin. As an example, the object can use the type of vibration mechanism that exists in many pagers and cell phones that, when in vibrate mode, cause the pager or cell phone to vibrate. As will be described herein, the vibration induced by the vibration mechanism can cause the object to move across the surface of a body of liquid. Most commonly the liquid fluid is water.

The vibration-powered object of the present disclosure includes a body 110 with a top side 102 adapted to be at least partially disposed above the surface 1010 of the liquid, and a bottom side 104 adapted to be at least partially submerged below the surface 1010 of the liquid. A vibration mechanism 200 is disposed in the body 110. A propulsion fin 300 is connected to the body 110. The fin includes a top side 302 adapted to be disposed at least partially above the liquid surface 1010, a bottom side 304 adapted to be disposed at least partially below the surface 1010. The vibration mechanism 200 is adapted to oscillate the free distal end 308 of the propulsion fin 300 upward and downward.

The vibration-powered object of this disclosure is distinguishable from prior art paddle powered floating objects. A prior art object is moved forward due to the reactionary force created by the paddle displacing fluid in the path of the paddle. However, the object of the present disclosure is moved forward, at least in part when the fin oscillates upwards, an inflow portion of the liquid fills a void created by the upward movement of the fin due to surface tension of the liquid on the fin and forms a meniscus; then when the fin moves downward, a portion of the inflow liquid is expelled along and behind the bottom surface 304 of the fin, thereby moving the meniscus 600 in a vector away from the body and propelling the object 100 along the upper surface 1010 of the liquid 1000.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF THE INVENTION

Figure 1A:
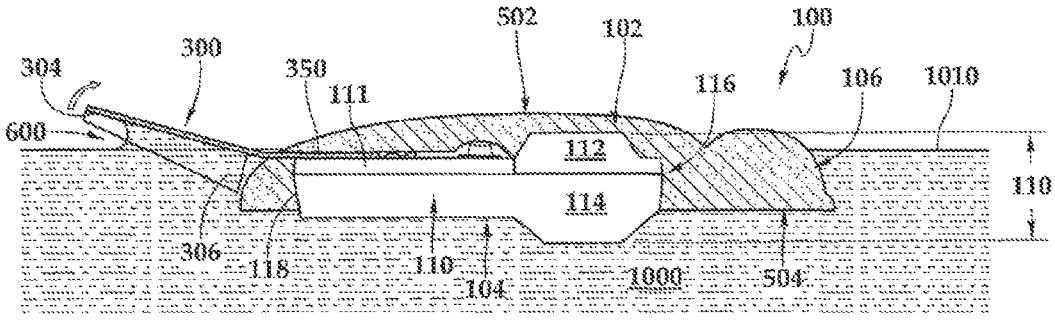
FIG. 1A is a cross-section of a vibration-powered object adapted for flotation and propulsion in a liquid body.
Figure 1B:
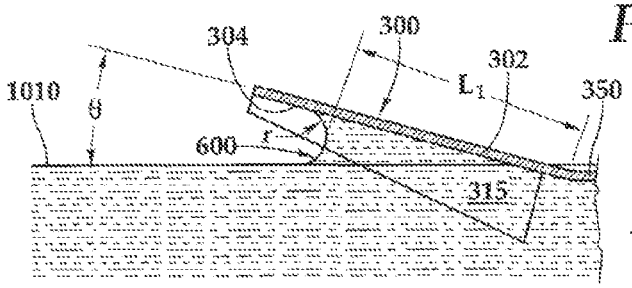
FIG. 1B is an enlarged portion of FIG. 1A.
Figure 2A:
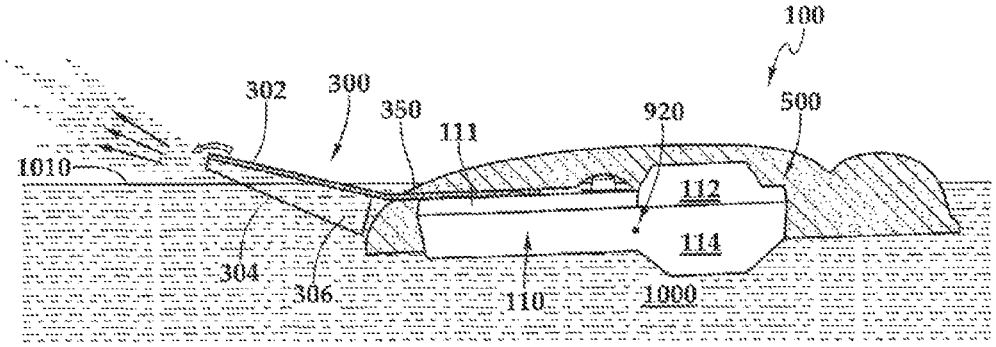
FIG. 2A is a cross-section of the object of FIG. 1A in a different flotation position in the liquid body wherein the propulsion fin is oscillated downward.
Figure 2B:
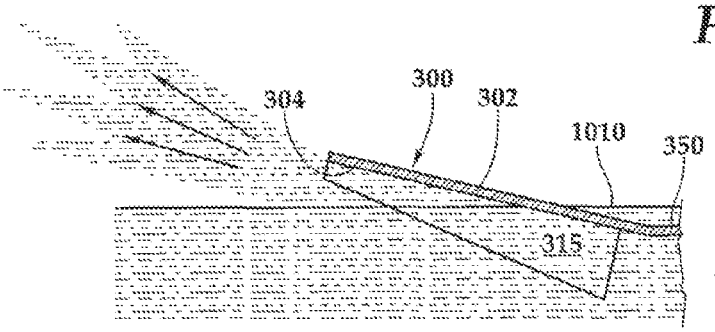
FIG. 2B is an enlarged portion of FIG. 2A.

FIGS. 1A, 1B, 2A, 2B and 3 illustrate a vibration-powered object 100 (e.g., a self-propelled device) adapted for flotation and propulsion of the object 100 on an upper surface 1010 in a body of liquid 1000. The vibration-powered object 100 has a top side 102 adapted to be at least partially disposed above the surface 1010 of the liquid 1000 and a bottom side 104 adapted to be at least partially submerged below the surface of the liquid. The object 100 has a front end 106 and a rear end 118. The object 100 has a body 110 including a forward top portion 112, a rearward top portion 111, a bottom portion 114, a front end 116 of the body 110, and a rear end 118 of the body 110.

FIGS. 4A to 4E illustrate an exploded perspective view of the body 110 including a vibration mechanism 200 and a propulsion fin 300. The vibration mechanism 200 is disposed in a water resistant cavity 122 located in the bottom portion 114 of the body 110. The vibration mechanism 200 includes a rotational motor 202 adapted to rotate an eccentric load 204. In some implementations, the rotation is approximately in the range of 6000-9000 revolutions per minute (rpm's), although higher or lower rpm values can be used. A longitudinal axis 206 of the vibration mechanism 200 is generally parallel to a longitudinal axis 120 of the body 110, although in alternative implementations the longitudinal axis 206 of the vibration mechanism 200 may be situated at an angle relative to the longitudinal axis 120 of the body 110. The vibration mechanism further includes a battery 210 disposed in the water resistant cavity 124 in the bottom portion 114 of the body 110. The vibration mechanism includes an on/off switch 220. The on/off switch 220 is disposed in the body 110. A water resistant cap 140 is positioned over actuation member 222 of the switch and in one embodiment the cap 140 and actuation member 222 may be accessible manually from an upper exterior surface of the body 110. Alternatively, the on/off switch 220 may include a receiver that receives a signal from a remote transponder thereby remotely controlling the vibration mechanism with a remote signal (e.g., using radio or infrared signals). In an alternative embodiment toy vibration-powered vehicle designed for moving on land (e.g. a HEXBUG NANO available from Innovation First International) may function as a vibration mechanism 200.

Figure 5A:
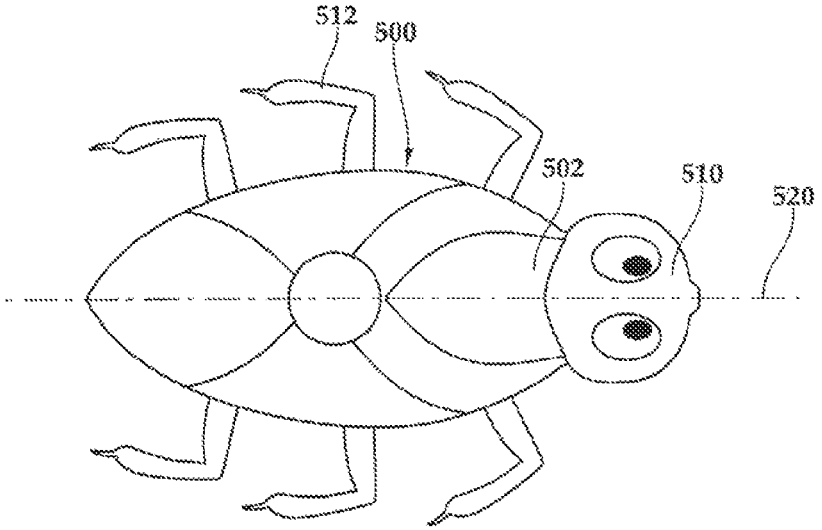
FIG. 5A is a top view of a flotation member for the vibration-powered object.
Figure 5B:
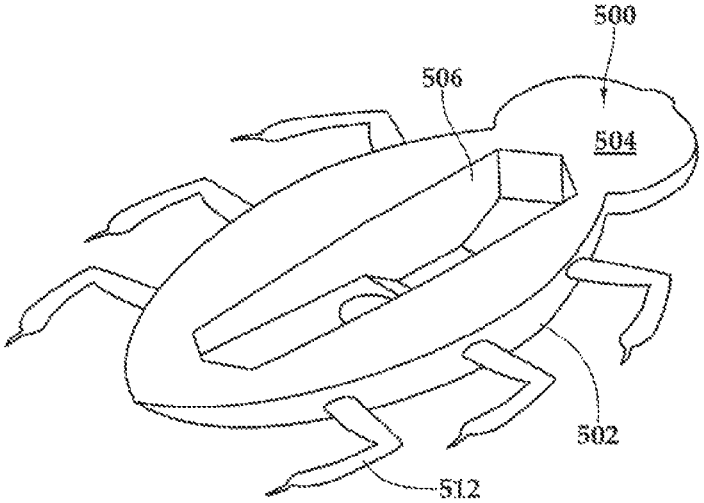
FIG. 5B is a perspective view of a bottom side of the flotation member of FIG. 5A illustrating a cavity therein for receiving the assembled body of the vibration-powered object of FIG. 4E.

As illustrated in the example embodiment shown in FIGS. 5A and 5B, the floating object 100 includes a flotation member 500 having a top surface 502 and a bottom surface 504. The body member 110 is assembled as illustrated in FIGS. 4A to 4E and inserted in a cavity 506 accessible from the bottom surface 504 of the flotation member 500. In some embodiments the flotation member 500 of the floating object may be configured as a water insect such that from above the body projects a generally oval body shape when the body is floating on a quiescent upper surface of the water body and wherein a major axis 520 of the oval is parallel to the vector of travel. A face 510 and legs 512 may be included on the insect for decorative effect. The flotation member may be formed from molded closed cell polyurethane or other buoyant material.

It will be understood that the flotation member 500 can be configured in numerous alternative shapes and may be removably attached to the body 110 and the flotation member 500 may be interchangeably used in different configurations of the flotation member 500. Alternatively, the flotation material may be disposed inside the body housing and reducing or eliminating the need for an external flotation member 500.

Figure 9A:
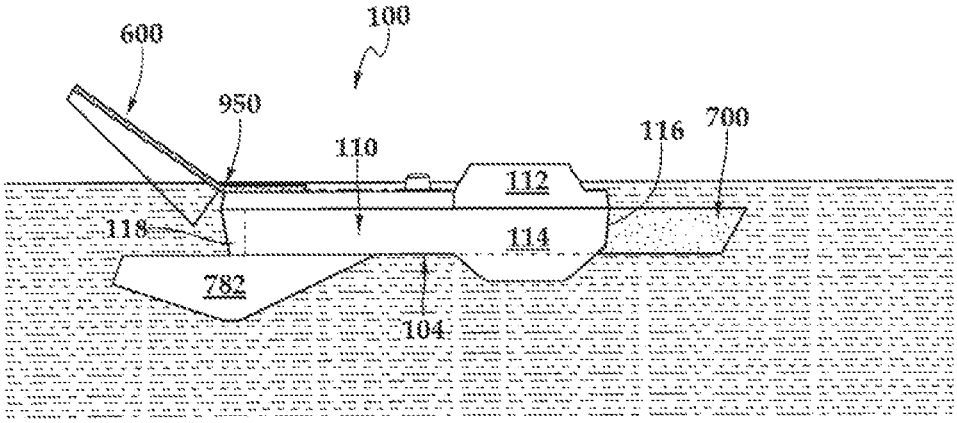
FIG. 9A is a cross-section of a vibration-powered object with a second embodiment of a flotation member.
Figure 9B:
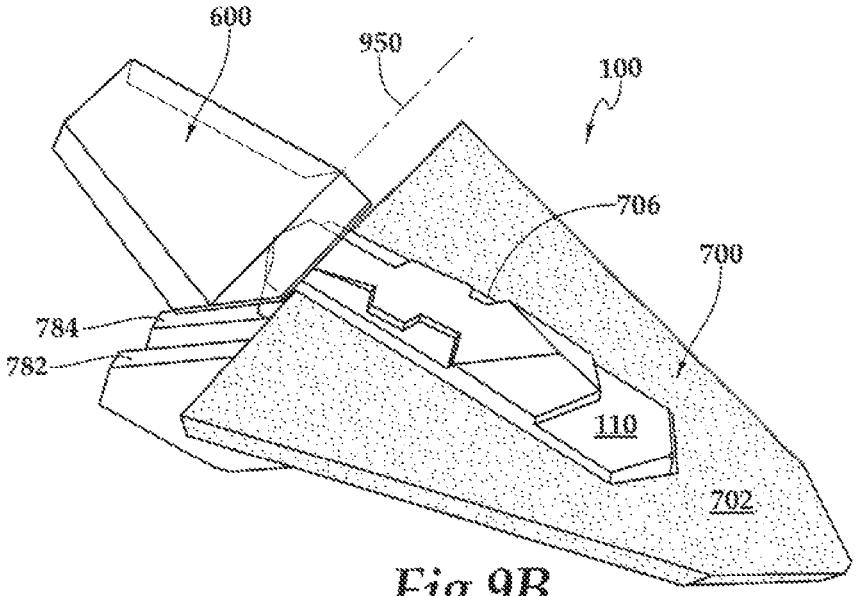
FIG. 9B is a perspective view of a top side of the vibration-powered object of FIG. 9A.
Figure 9C:
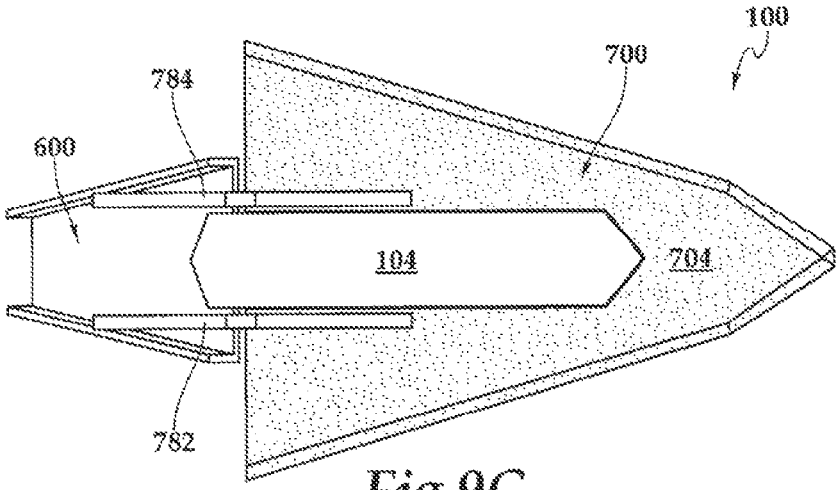
FIG. 9C is a bottom view of the vibration-powered object of FIG. 9A.

As illustrated in an alternative embodiment shown in FIGS. 9A, 9B, and 9C, the floating object 100 includes a flotation member 700 configured like a boat with a bow and stern and having a top surface 702 and a bottom surface 704. The body member 110 is assembled as illustrated in FIGS. 4A to 4E and inserted in a cavity 706 accessible from the top surface 702 of the flotation member 700. Flotation member 700 may further include one or more keel fins 782 and 784 connected to and disposed downward from the bottom side of the member 700. These keel fins can function as a rudder and assist with steering of the floating object 100.

Figure 10A:
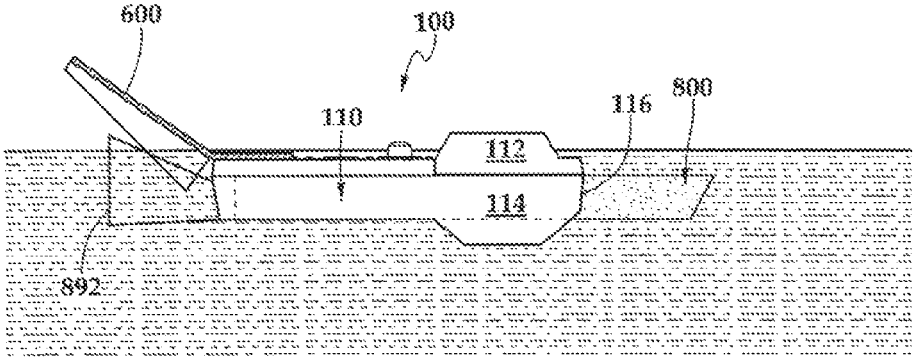
FIG. 10A is a cross-section of a vibration-powered object with a third embodiment of a flotation member and including a steering fin.
Figure 10B:
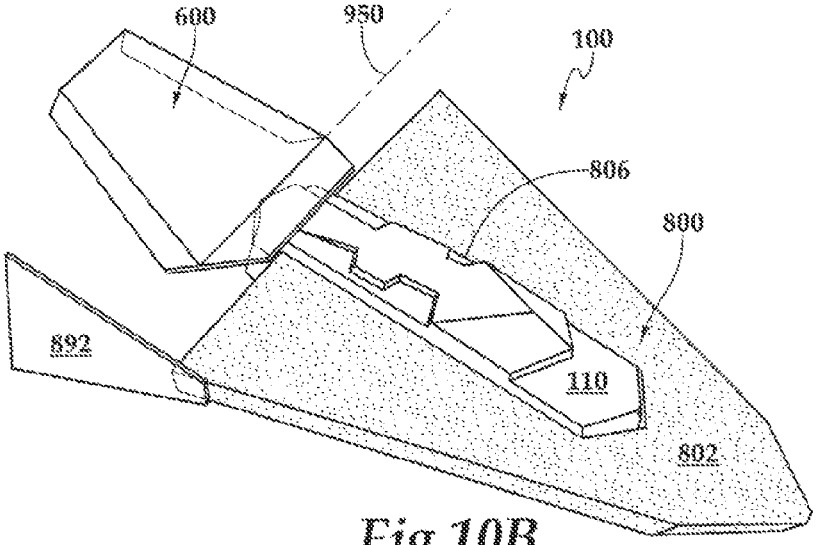
FIG. 10B is a perspective view of a top side of the vibration-powered object of FIG. 10A.
Figure 10C:
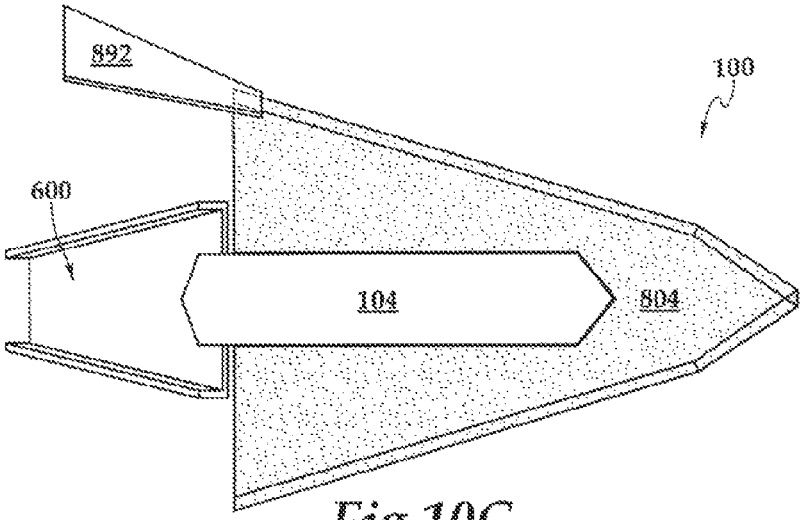
FIG. 10C is a bottom view of the vibration-powered object of FIG. 10A.

As illustrated in an additional alternative embodiment shown in FIGS. 10A, 10B and 10C, the floating object 100 includes a flotation member 800 configured like a boat with a bow and stern and having a top surface 802 and a bottom surface 804. The body member 110 is assembled as illustrated in FIGS. 4A to 4E and inserted in a cavity 806 accessible from the top surface 802 of the flotation member 800. The embodiment 800 further includes a steering fin 892 disposed on the rear of the flotation member 800. The rotation of the eccentric load 204 in the vibration mechanism 200 can cause the object 100 to veer to one side away from a forward vector. To which side the moving object veers can depend on the direction of rotation of the eccentric weight 204. The steering fin 892 can counteract the veering due to rotation of the vibration mechanism and help steer the floating object in a more straightforward vector. Therefore, the side on the floating object on which the steering fin is disposed will be determined by the direction of rotation of the eccentric load 204.

As illustrated in FIGS. 1, 2 and 3 and FIGS. 7A to 7E, a propulsion fin 300 with a proximal end 306 is connected to the rear end 118 of the body 110. The fin 300 is adapted to flex slightly relative to the body 110 (at least at flex axis 950) as the object 300 vibrates, although the fin 300 is also adapted to provide some resilience (e.g., such that the fin 300 tends to deflect only a few degrees and tends to return to a neutral position, such as that illustrated in FIGS. 1, 2, and 3). Vibration of the object 100 as a result of the vibration mechanism 200 is very minimal due to the size and surface area of 100. The fin 300 is free to oscillate up and down around the rotation axis 950. When the fin 300 is in contact with the liquid 1000 it will deflect less than when the fin 300 is in free space (e.g., air) due to the higher viscosity of water when compared to that of air. Generally, however, the fin 300, while capable of flexing at least at flex axis 950, will have some resistance to freely flexing away from a neutral position. The fin 300 includes a free distal end 308 opposite the proximal end 306. The fin 300 has a top side 302 adapted to be disposed and, during operation of the object 100, to generally remain at least partially above the surface 1010 of the liquid 1000 and a bottom side 304 adapted to be disposed and, during operation of the object 100, to generally remain at least partially below the surface 1010 of the liquid 1000.

As illustrated in FIGS. 1 and 2, when the vibration mechanism 200 is operational it causes the free distal end 308 of the fin to oscillate upward and downward. The oscillation of the free distal end 308 results from flexing of the fin 300 at the flex axis 950 (i.e., upward and downward flexure movement of the free distal end relative to the flex axis 300). Minor upward and downward vibration of the object 100 is negligible (generally, the upward and downward vibration of the object 100 causes the entire fin 300 to move upward and downward as vibration of the object tends to induce an oscillation about an axis 920 passing approximately through a center of gravity of the object 100 and transverse to the longitudinal axis 120 of the body 110). In operation, the bottom side 304 of the fin contacts the surface 1010 of the body of liquid 1000 at a low angle (approximately 15 degrees). As shown in enlarged detail of FIG. 1A, when the fin 300 is at the upper end of its travel, water is pulled in by surface tension to the bottom of the fin and a meniscus 600 is formed between the surface 1010 and the bottom side 304 of the fin. This water and meniscus 600 fills a portion of the area between 304 and 1010. As the fin travels downward to the lower end of its travel, the area between 304 and 1010 is significantly reduced. The water that filled the area shown in FIG. 1A is forced by the fin to exit the area rearward. Vibration of the device that induces oscillation of the fin 300 causes the fin 300 to essentially pump liquid 1000 toward the free distal end 308, which in turn propels the floating object 100 along the surface 1010 of the body of liquid 1000 in a forward direction (i.e., in the direction of the front end 106 of the object 100).

The vibration amplitude of the fin 300 is dictated by the forces from 204 that rotate the body 100 about its center of rotation. The center of rotation is close to the center of gravity 920; however, it can vary based on the interaction of the lower side of the hull and the water 1000. By putting more distance between 202 and the center of rotation, the fin will oscillate with greater magnitude.

Figure 3:
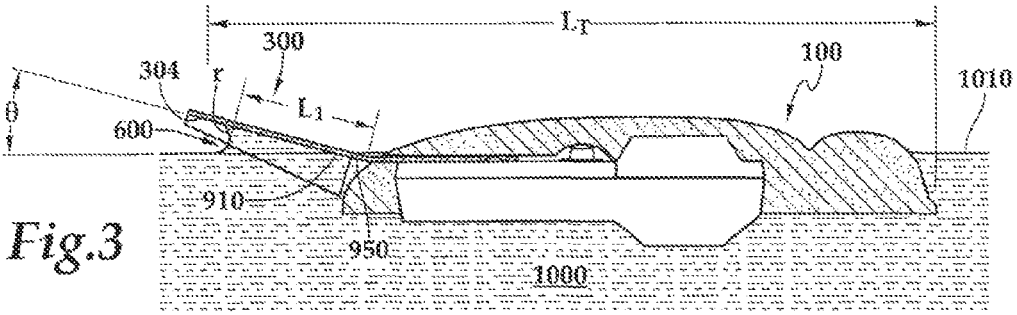
FIG. 3 is a cross-section of the object of FIG. 1A illustrated as floating in a quiescent body of liquid with the vibration mechanism turned off.
Figure 4A:
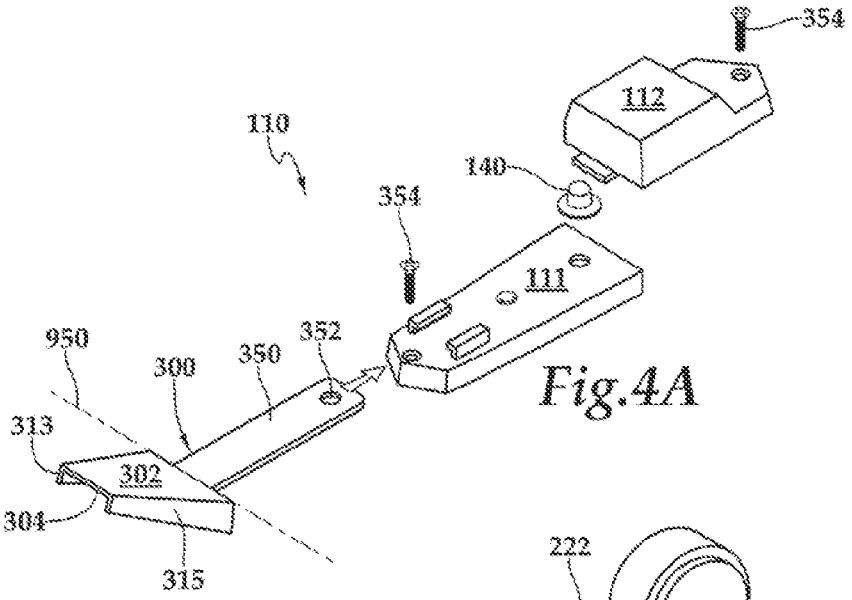
FIGS. 4A to 4E are exploded perspective views of a body of the vibration-powered object containing a vibration mechanism and a propulsion fin.
Figure 4B:
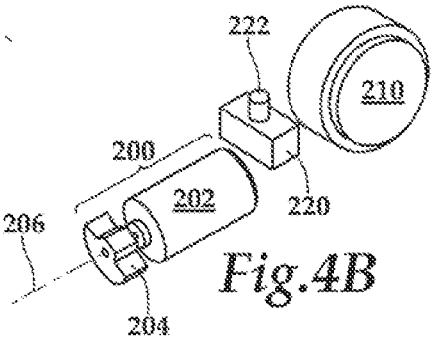
Figure 4C:
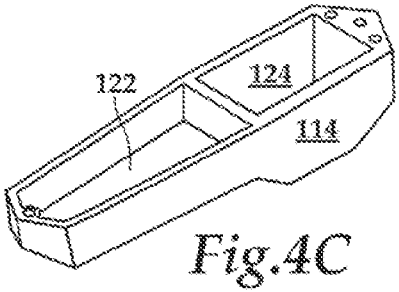
Figure 4D:
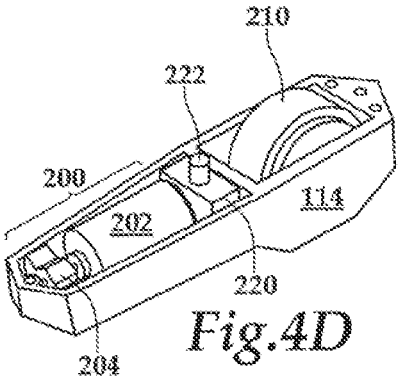
Figure 4E:
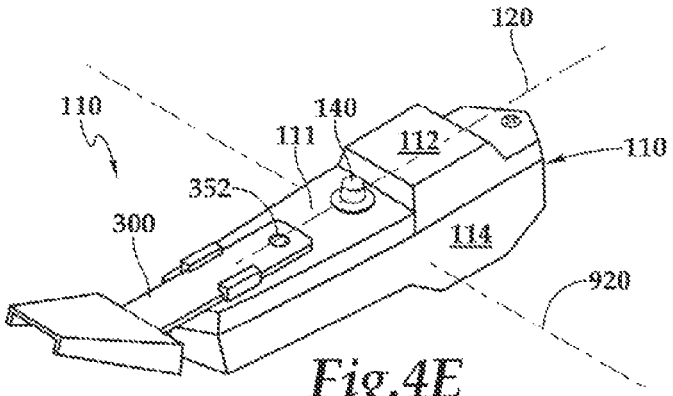
Figure 6:
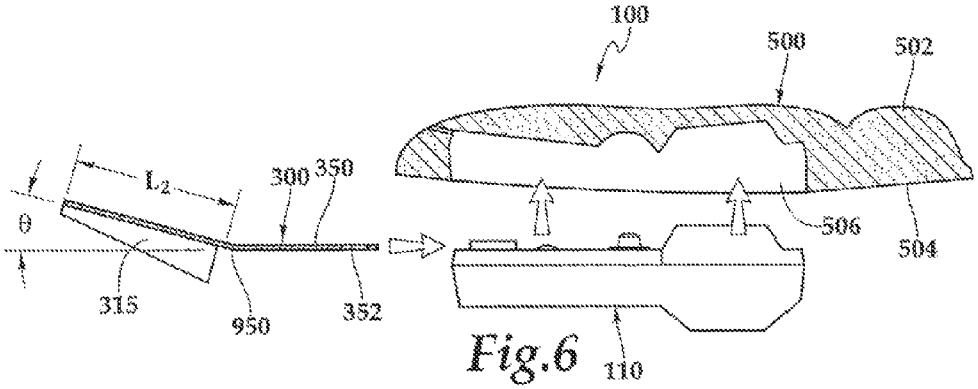
FIG. 6 is a partially exploded cross-section view of the flotation member, body and propulsion fin of the vibration-powered object.
Figure 7A:
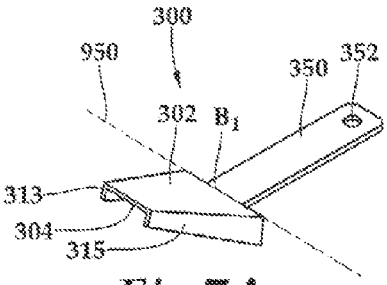
FIG. 7A is a perspective view of the first embodiment of the propulsion fin of the vibration-powered object.
Figure 7B:
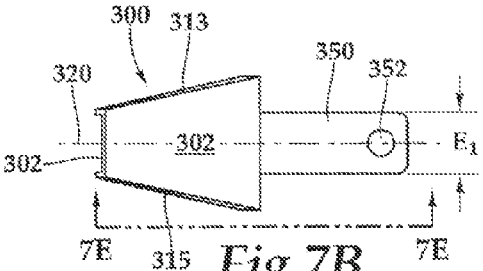
FIG. 7B is a top view of the propulsion fin of FIG. 7A.
Figure 7C:
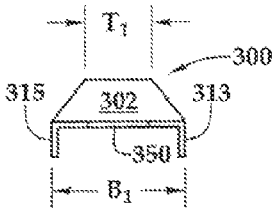
FIG. 7C is an end view of the propulsion fin FIG. 7B.
Figure 7D:
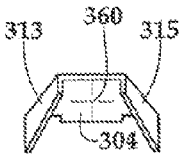
FIG. 7D is a bottom view of the propulsion fin of FIG. 7A taken at section 7D of FIG. 7E.
Figure 7E:
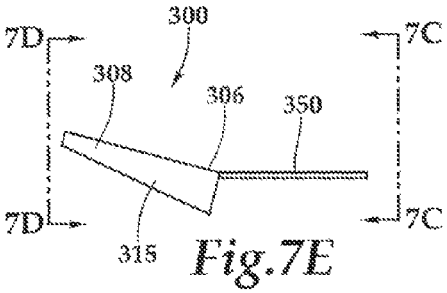
FIG. 7E is a side view of the propulsion fin of FIG. 7A.
Figure 8B:
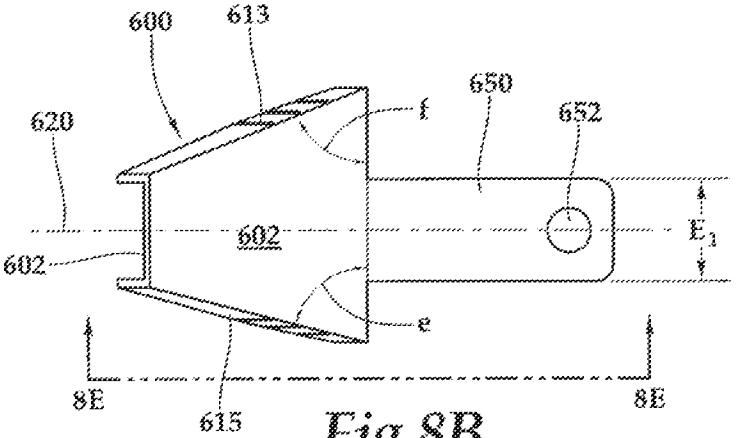
FIG. 8B is a top view of the propulsion fin of FIG. 8A.
Figure 8E:
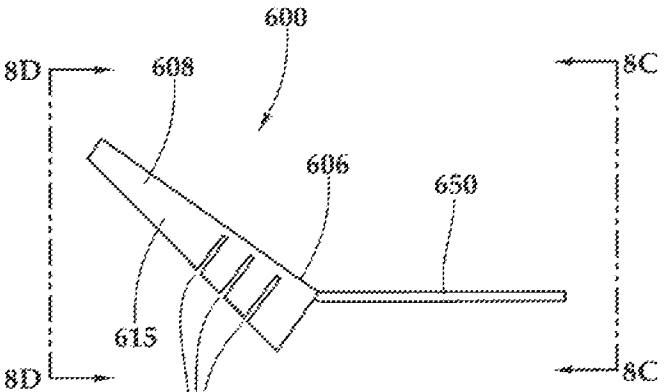
FIG. 8E is a side view of the propulsion fin of FIG. 8A.
Figure 8A:
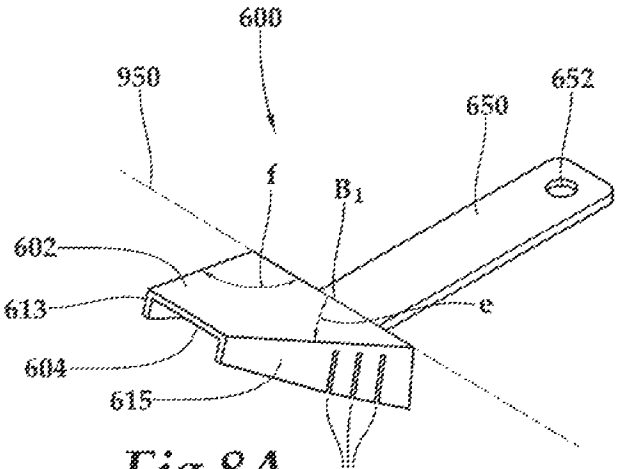
FIG. 8A is a perspective view of a second embodiment of the propulsion fin of the vibration-powered object.
Figure 8D:
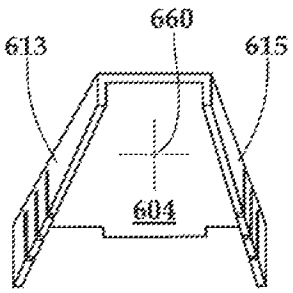
FIG. 8D is a bottom view of the propulsion fin of FIG. 8A taken at section 8D of FIG. 8E.
Figure 8C:
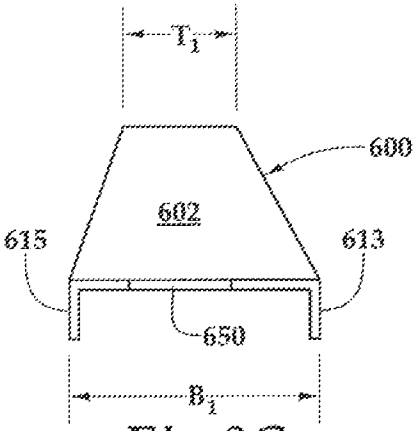
FIG. 8C is an end view of the propulsion fin of FIG. 8A.

As illustrated in FIG. 3 and FIG. 6, the propulsion fin is disposed at an angle (theta) of about 15 degrees, measured with a first side of the angle being parallel to the horizontal top surface of the fluid 1010 at a point where the propulsion fin is contacting the horizontal top surface of the fluid body 1000 in a substantially quiescent state, and a second side of the angle being a tangent to the propulsion fin extending from the surface of the fluid. In some embodiments, the angle (theta) is generally between about 10 and 45 degrees, although other angles may also provide useful propulsion in some implementations.

A meniscus 600 is formed on the surface 1010 of the liquid when the horizontal surface of the liquid 1000 is in a substantially quiescent state (FIG. 1C) at a point 910 where the bottom surface 304 of the propulsion fin 300 contacts the surface 1010 of the fluid. The meniscus is located a distance L1 from the intersection of 304 and 1010. The flex axis 950 allows for upward and downward flexible movement of the propulsion fin relative to the body 110. The flex axis is transverse to a longitudinal axis of the propulsion fin. The flex axis 950 is disposed toward the proximal end 306 of the propulsion fin 300. The distance L1 can be calculated based on theta and the meniscus radius (r) caused by water contact with 304. The position of the meniscus moves away from the proximal end toward the distal end of the propulsion fin when the propulsion fin oscillates downward relative to the surface 1010 of the liquid 1000. Relatively increased rate of propulsion can be achieved by configuring the propulsion fin 300 such that the flex axis 950 (or the proximal end 306) remains below the surface 1010 of the liquid 1000 even as the fin 300 reaches its highest point induced by vibration of the object 100.

As shown in FIGS. 3 and 7A to 7E, the propulsion fin 300 further may have a right side with a right lip 313 disposed downward and adapted to at least partially contact the surface 1010 of the liquid 1000 and a left side with a left lip 315 disposed downward and adapted to at least partially contact the surface 1010 of the liquid. When the propulsion fin 300 oscillates upward, liquid flows in and fills a void created by upward movement of the fin 300. When the fin 300 moves downward, the right lip and left lip are adapted to direct water rearward as the fin 300 moves downward.

In some implementations as illustrated in FIGS. 7A to 7E, the fin 300 has a generally planar top side 302, said top side of the fin being shaped like a regular trapezoid (i.e., a truncated pyramid) with the base B1 being the proximal end 306 of the fin 300 and the truncated top T1 of the regular trapezoid being the distal end 308 of the fin 300.

Alternatively, in a second implementation as illustrated in FIGS. 8A to 8E, the propulsion fin 600 may have a generally planar top side 602, said top side of the fin being shaped like an asymmetrical trapezoid with the base B1 being the proximal end of the fin connected to the body and the shorter top end T1 being the distal end of the fin. In such an asymmetrical embodiment, a first angle (e) measured from the first side of the trapezoidal fin and the base of the trapezoidal fin, is not equal to a second angle (f) measured from the second side of the trapezoidal fin and the base. An asymmetrical configuration of the fin 600 affects the vector of travel of the object 100 (i.e., based on the direction in which different angled lips tend to direct water flow) and may be used for steering purposes. Elements in the alternative embodiment of propulsion fin 600 having similar configurations and functions to those in FIGS. 8A to 8E have been assigned similar reference numbering but using a 600 series of numbering. In an alternative implementation as shown in FIGS. 8A to 8E, the left lip and right lip may have one or more slits 680 in each lip thereby adjusting the flexibility of the propulsion fin 600 (i.e., allowing the fin 600 to flex between the proximal end 606 and the distal end 608).

As shown in FIGS. 4A to 4E, and 6, the proximal end 306 of the propelling fin is connected to the body 110 by an extension 350 of the propulsion fin 300. Extension 350 has an aperture or apertures 352 that receive a fastener 354 to attach the fin 300 to upper body 111 at the rear end 118 of the body 110. Alternatively, the propulsion fin 300 may be inserted into a slit in an upper surface of the rear of the body and/or may be attached using any other suitable technique (e.g., glue).

In some embodiments, the fin 300 has a generally planar top side 302 shaped like a trapezoid having a base width (B1) and a narrower top width (T1). The extension member 350 has a width (E1) measured where the extension member 350 is connected to the base of the trapezoidal shaped fin 300. In some embodiments, it may be desirable to configure the extension member width (E1) as less than a width (B1) of the base of the trapezoid, thereby imparting flexibility to the flex axis 950 located where the extension member 350 is connected to the base of the trapezoidal shaped fin 300. For example, when the extension member 350 and the fin 300 have a unitary construction (i.e., constructed as a single component), the width (E1) of the extension member where it meets the base of the trapezoidal shaped fin 300 can impact the degree of flexibility at the flex axis 950 and may increase the speed of propulsion when the object 100 is activated.

Alternatively, in a third implementation as illustrated in FIGS. 12A to 12E, a propulsion fin 1100 may have a generally rectangular planar top side 1102, and left and right lips 1113 and 1115 being wider at the distal end 1104 of the fin and narrowing at the junction with the extension member 1150. Elements in the alternative embodiment of propulsion fin 1100 having similar configurations and functions to those in FIGS. 5A to 5E have been assigned similar reference numbering but using an 1100 series of numbering.

Alternatively, in a fourth implementation as illustrated in FIGS. 13A to 13E, a propulsion fin 1200 may have a generally trapezoidal planar top side 1202, and left and right lips 1213 and 1215 being narrower at the distal end 1204 of the fin and widening at the junction with the extension member 1250. Elements in the alternative embodiment of propulsion fin 1200 having similar configurations and functions to those in FIGS. 5A to 5E have been assigned similar reference numbering but using a 1200 series of numbering.

Alternatively, in a fifth implementation as illustrated in FIGS. 14A to 14E, a propulsion fin 1300 may have a generally "U" shape with a curved top 1302, and left and right lips 1313 and 1315. Elements in the alternative embodiment of propulsion fin 1300 having similar configurations and functions to those in FIGS. 5A to 5E have been assigned similar reference numbering but using a 1300 series of numbering.

Alternatively, in a sixth implementation as illustrated in FIGS. 15A to 15E, a propulsion fin 1400 may have a generally trapezoidal top side 1402. The trapezoidal top side is concave downward. Left and right lips 1413 and 1415 are narrower at the distal end 1404 of the fin and widening at the junction with the extension member 1450.

Elements in the alternative embodiment of propulsion fin 1400 having similar configurations and functions to those in FIGS. 5A to 5E have been assigned similar reference numbering but using a 1400 series of numbering.

Alternatively, in a seventh implementation as illustrated in FIGS. 16A to 16E, a propulsion fin 1500 being shaped like a portion of a cone with a generally curved top side 1502, and curved left and right sides 1513 and 1515. Elements in the alternative embodiment of propulsion fin 1500 having similar configurations and functions to those in FIGS. 5A to 5E have been assigned similar reference numbering but using a 1500 series of numbering.

Figure 11A:
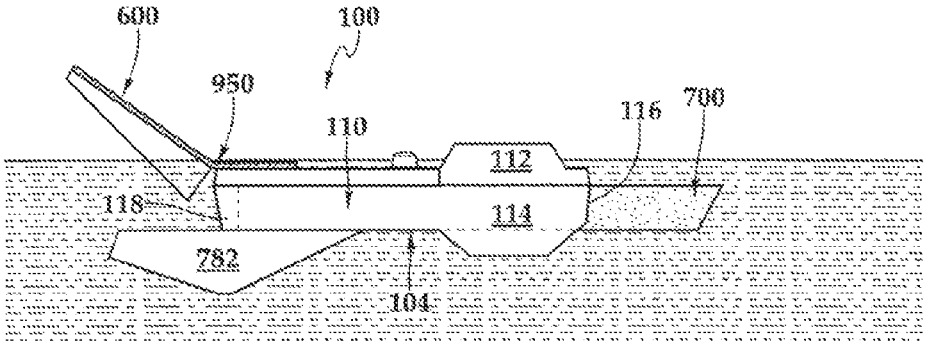
FIG. 11A is a cross-section of a vibration-powered object with a fourth embodiment of a flotation member and including two propulsion fins.
Figure 11B:
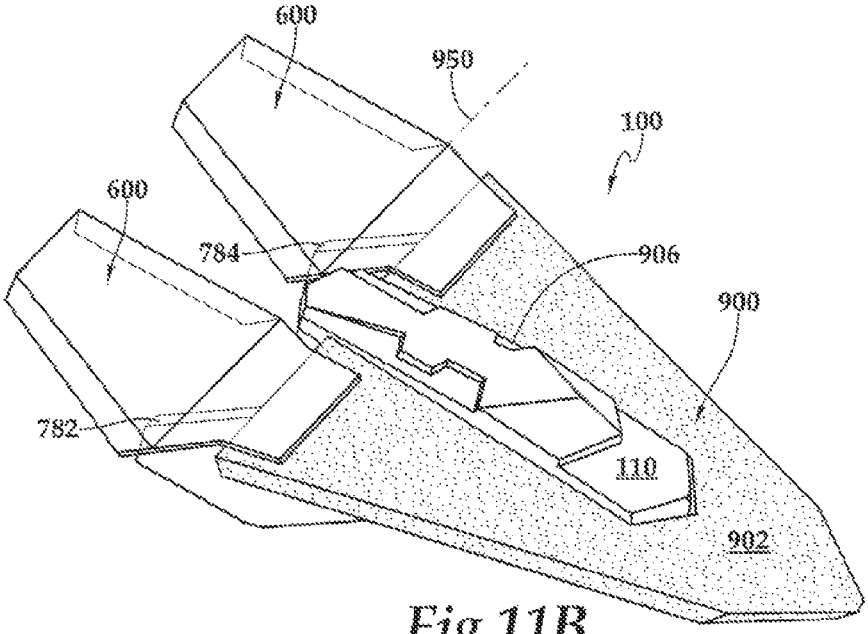
FIG. 11B is a perspective view of a top side of the vibration-powered object of FIG. 11A.
Figure 11C:
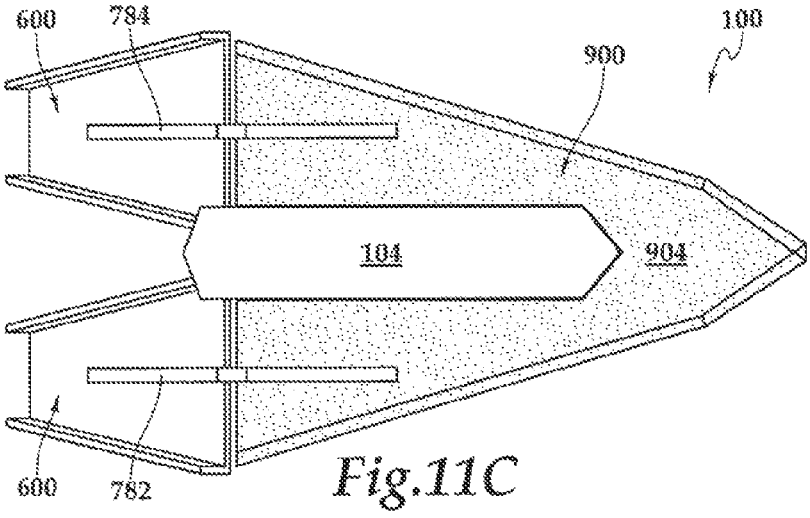
FIG. 11C is a bottom view of the vibration-powered object of FIG. 11A.
Figure 12A:
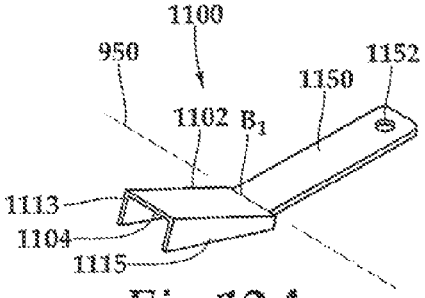
FIG. 12A is a perspective view of a third embodiment of the propulsion fin of the vibration-powered object.
Figure 12B:
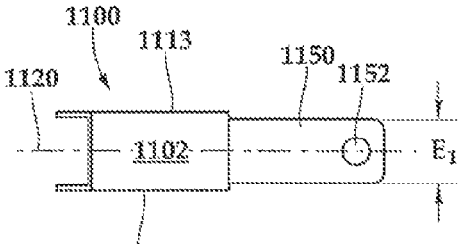
FIG. 12B is a top view the propulsion fin of FIG. 12A.
Figure 12C:
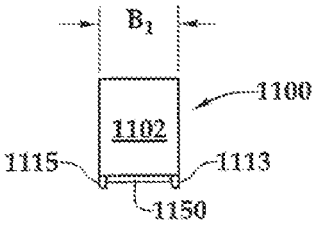
FIG. 12C is an end view of the propulsion fin of FIG. 12A.
Figure 12D:
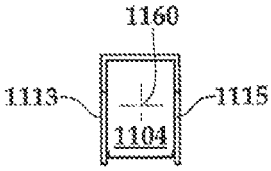
FIG. 12D is a bottom view of the propulsion fin of FIG. 12A taken at section 12D of FIG. 12E.
Figure 12E:
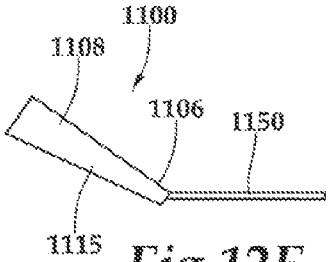
FIG. 12E is a side view of the propulsion fin of FIG. 12A.
Figure 13A:
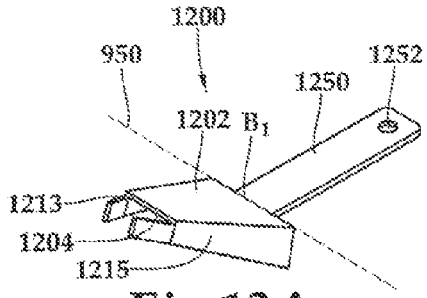
FIG. 13A is a perspective view of a fourth embodiment of the propulsion fin of the vibration-powered object.
Figure 13B:
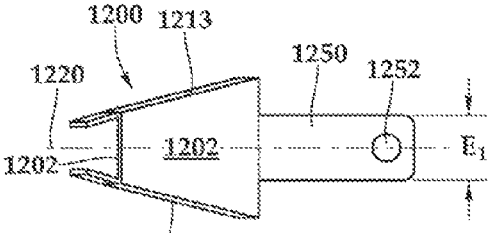
FIG. 13B is a top view of the propulsion fin of FIG. 13A.
Figure 13C:
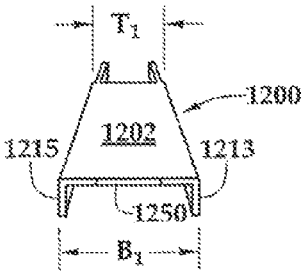
FIG. 13C is an end view of the propulsion fin of FIG. 13A.
Figure 13D:
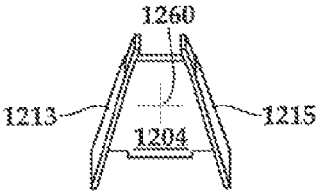
FIG. 13D is a bottom view of the propulsion fin of FIG. 13 A taken at section 13D of FIG. 13E.
Figure 13E:
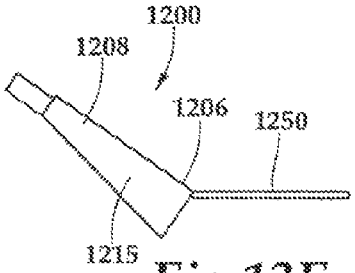
FIG. 13E is a side view of the propulsion fin of FIG. 13A.
Figure 14A:
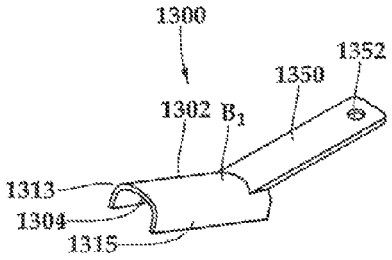
FIG. 14A is a perspective view of a fifth embodiment of the propulsion fin of the vibration-powered object.
Figure 14B:
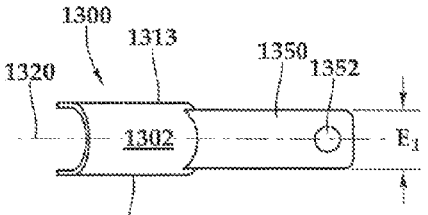
FIG. 14B is a top view of the propulsion fin of FIG. 14A.
Figure 14C:
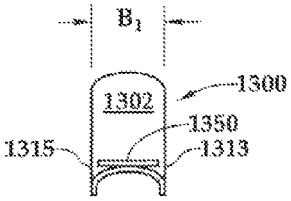
FIG. 14C is an end view of the propulsion fin of FIG. 14A.
Figure 14D:
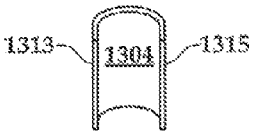
FIG. 14D is a bottom view of the propulsion fin of FIG. 14A taken at section 14D of FIG. 14E.
Figure 14E:
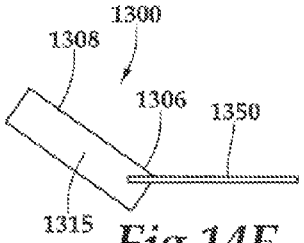
FIG. 14E is a side view of the propulsion fin of FIG. 14A.
Figure 15A:
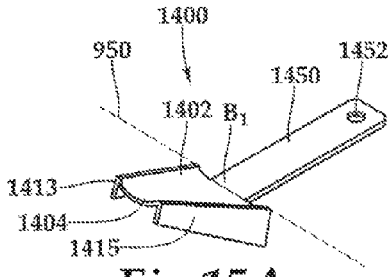
FIG. 15A is a perspective view of a sixth embodiment of the propulsion fin of the vibration-powered object.
Figure 15B:
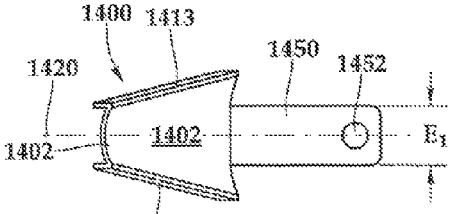
FIG. 15B is a top view of the propulsion fin of FIG. 15A.
Figure 15C:
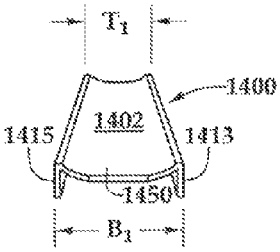
FIG. 15C is an end view of the propulsion fin of FIG. 15A.
Figure 15D:
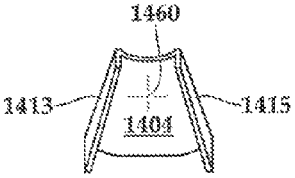
FIG. 15D is a bottom view of the propulsion fin of 15A taken at section 15D of FIG. 15E.
Figure 15E:
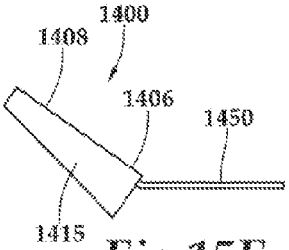
FIG. 15E is a side view of the propulsion fin of FIG. 15A.
Figure 16A:
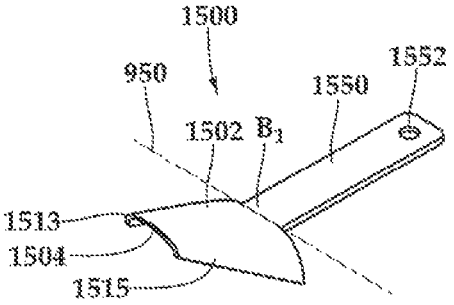
FIG. 16A is a perspective view of a seventh embodiment of the propulsion fin of the vibration-powered object.
Figure 16B:
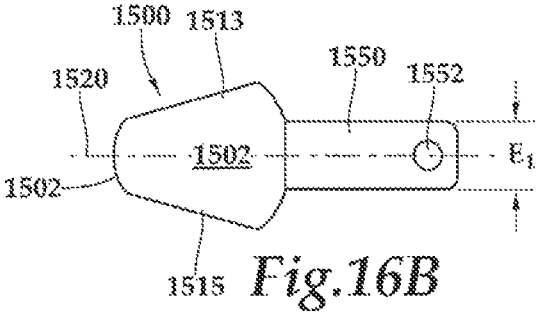
FIG. 16B is a top view of the propulsion fin of FIG. 16A.
Figure 16C:
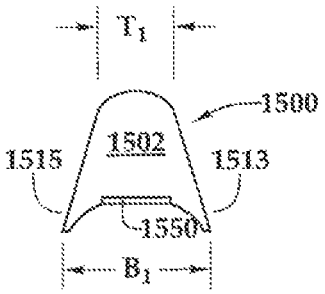
FIG. 16C is an end view of the propulsion fin of FIG. 16A.
Figure 16D:
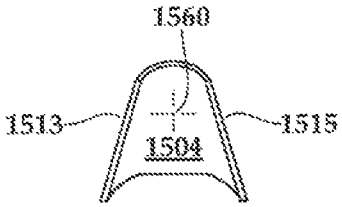
FIG. 16D is a bottom view of the propulsion fin of FIG. 16A taken at section 16D of FIG. 16E.
Figure 16E:
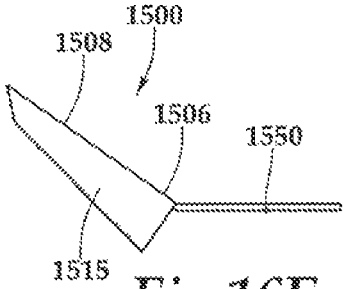
FIG. 16E is a side view of the propulsion fin of FIG. 16A.

As illustrated in FIGS. 11A, 11B and 11C, in some embodiments, the vibration-powered object 100 further includes a second propulsion fin 600 (i.e., such that a first fin 600 is disposed to one side of the longitudinal axis of the object 100 and the second fin 600 is disposed to the other side of the longitudinal axis of the object 100) having a proximal end 606 connected to the body 110 and a free distal end 608 opposite the proximal end. The second fin having a top side 602 adapted to be disposed at least partially above the surface 1010 of the liquid 1000 and a bottom side 604 adapted to be disposed at least partially below the surface 1010 of the liquid. It will be understood that any one of the embodiments of propulsion fin 300, 600, 1100, 1200, 1300, 1400, 1500, or a combination of any elements from these embodiments may be used in the first or second propulsion fin of this embodiment. Steering can be impacted by varying the distance of each fin 600 from the longitudinal axis of the object 100, or by varying the size, shape, and/or orientation of each of the two fins 600.

Any of the propulsion fins 300, 600, 1100, 1200, 1300, 1400, 1500 may be formed from a material selected from a group consisting of polymeric compounds, synthetic rubber, natural rubber, and elastomers. The propulsion fin 300 may be formed from a film of polymeric material, such as polyethylene or polystyrene. The film may have a thickness and modulus of elasticity that supports oscillation at the natural frequency of the vibration motor.

In some embodiments of the object, the total longitudinal length LT of the floating object 100 is between 1.0 and 4.0 inches.

Experimental data has indicated that by reducing an amount of water that is on the top side 302 of the propulsion fin 300, the object 100 may be propelled more efficiently. In some embodiments, the top side 302 of the propulsion fin is coated with a compound which reduces the surface tension between the top surface 302 and water contacting said surface, such that water is repelled off the top surface 302 of the fin 300. Alternatively, at least one layer of low density, non-porous material may be disposed on the generally planar top side 302 of the fin 300 to reduce the volume of water on top of the fin.

When floating object 100 is adapted for use as a toy, the floating object may be adapted to move autonomously and, in some implementations, turn in seemingly random directions. As a result, the toy floating objects, when in motion, can resemble organic life, such as bugs or insects or may resemble motor boats, airplanes, space ships or other desirable configurations.

The speed and direction of the floating object's movement can depend on many factors, including the rotational speed of the vibrating mechanism 200, the size of the offset weight 204 attached to the motor 202, the power supply, the configuration characteristics (e.g., size, orientation, shape, material, flexibility, frictional characteristics, etc.) of the propulsion fin 300, the properties of the surface 1010 of liquid 1000 on which the object 100 floats, the overall weight of the object 100, the buoyancy of the flotation member 500, and so on.

In some implementations, the floating object 100 includes features that are designed to compensate for a tendency of the device to turn as a result of the rotation of the counterweight 204 (e.g., based on the size, shape, and/or configuration of the propulsion fins 300, 600, 1100, 1200, 1300, 1400, 1500 or the steering fin 892 and keel fins 782 and 784). The components of the object 100 can be positioned to maintain a relatively low center of gravity (or center of mass) to discourage tipping and to align the components with the rotational axis of the rotating motor to encourage rolling. Likewise, the floating object can be designed to encourage self-righting based on features that tend to encourage rolling when the device is on its back or sides. Features of the object can also be used to increase the appearance of random motion and to make the device appear to respond intelligently to obstacles.

Figure 17:
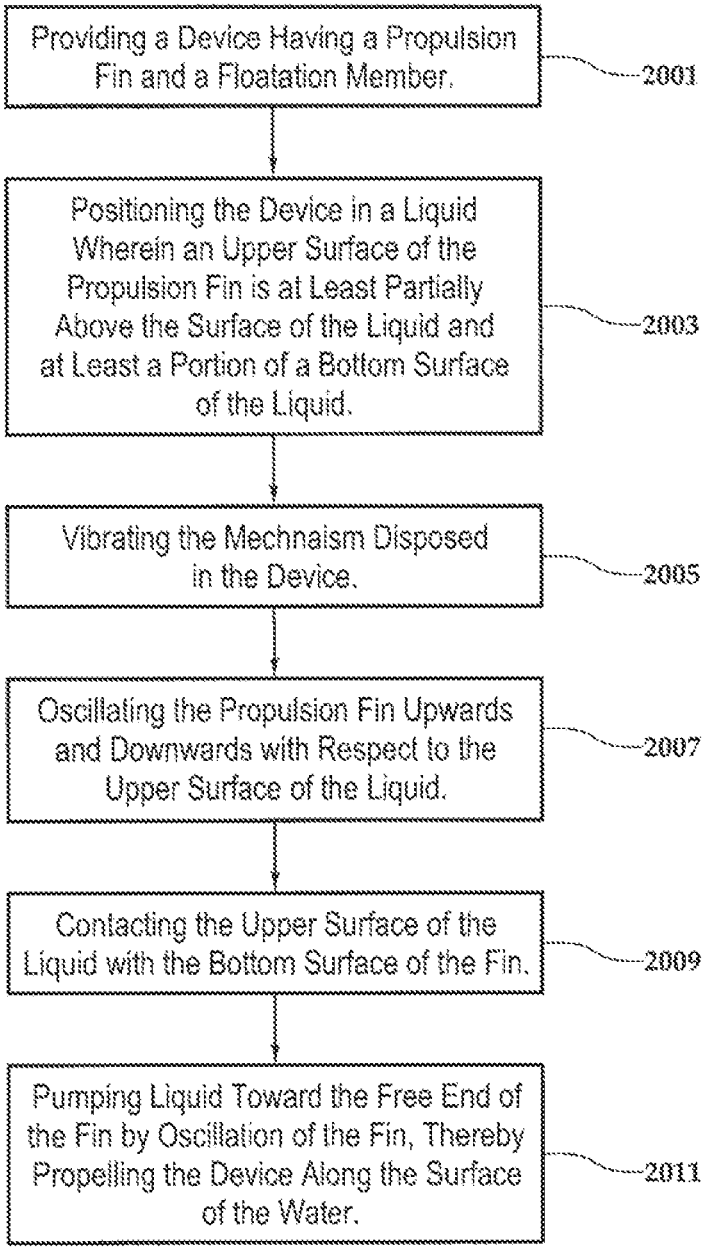
FIG. 17 is a flow chart illustrating a method of propelling the vibration-powered object.

As Illustrated in FIG. 17, when in operation at steps 2001 and 2003 an object 100 having a propulsion fin 300, 600, 1100, 1200, 1300, 1400 or 1500 and a flotation member 500, 700 or 800 is positioned in the liquid 1000 with the top side 102 of the body 110 being at least partially above an upper surface 1010 of the liquid, and the bottom side 118 being at least partially submerged below the horizontal surface 1010 of the liquid 1000. For example, the propulsion fin 300 is positioned with a top side 302 at least partially above the upper surface 1010 of the liquid 1000, the bottom side 304 at least partially below the upper surface 1010 of the liquid. As illustrated in steps 2005, 2007 and 2009, the vibration mechanism is activated and oscillates the propulsion fin 300 upward and downward. The bottom side 304 of the fin contacts that surface 1010 of the body of the liquid. When the fin 300 is at the upper end of its travel, a meniscus 600 is formed between the surface 1010 and the bottom side 304 of the fin. The meniscus fills a portion of the area between 304 and 1010. As the fin travels downward to the lower end of its travel, the area between 304 and 1010 is significantly reduced. The fluid is forced by the fin to exit the area rearward. As illustrated in step 2011, vibration of the device that induces oscillations in the fin 300 causes the fin 300 to essentially pump liquid 1000 toward the free distal end 308, which in turn propels the floating object 100 along the surface 1010 of the body of liquid 1000 in a forward direction (i.e., in the direction of the front end 106 of the object 100).

It will be understood that any one of the embodiments of propulsion fin 300, 600, 1100, 1200, 1300, 1400, 1500, or a combination of any elements from these embodiments may be used to propel the object 100. Further, it will be understood that any one of the flotation members 500, 700, 800 or other flotation configurations may be used to provide buoyancy to the object 100.

A number of embodiments of the invention have been described. Nevertheless, it will be understood that various modifications may be made without departing from the spirit and scope of the invention. Accordingly, other embodiments are within the scope of the following claims.

We claim:

1. A method of propelling a vibration-powered device floating on an upper surface in a liquid, said method comprising:

providing a device having a body with an internal water-resistant cavity and an external surface, the body further having a longitudinal axis, a front end portion and a rear end portion, a top side and a bottom side;

providing a flotation member, the flotation member having a recess configured to directly secure to a portion of the external surface of the body, the flotation member having a shape configured to substantially maintain a portion of the top side of the body above the surface of the liquid and further configured to substantially maintain a portion of the bottom side of the body below the surface of the liquid when the flotation member is secured to the portion of the external surface of the body;

vibrating a vibration mechanism disposed within the internal water resistant cavity and the vibration mechanism having a rotational motor adapted to rotate an eccentric load; and oscillating a free distal end of a propulsion fin upward and downward in response to the actuation of the vibration mechanism, and wherein said fin having a proximal end opposite the free distal end and the proximal end being connected to the body, said fin having a top side adapted to be disposed at least partially above the surface of the liquid, said fin having a bottom side adapted to be disposed at least partially below the surface of the liquid.

2. The method of claim 1, wherein oscillating the propulsion fin includes flexing of the fin at a flex axis in an upward and downward flexure movement of the free distal end relative to the flex axis.

3. The method of claim 1, wherein vibrating the vibration mechanism includes oscillating the propulsion fin upwards and downwards about an axis passing approximately through a center of gravity of the body and transverse to the longitudinal axis of the body.

4. The method of claim 1, wherein oscillating the propulsion fin includes forming a meniscus form on the surface of the fluid in which the device is adapted to float, said meniscus being located at a point where the surface of the liquid contacts the bottom side of the propulsion fin.

5. The method of claim 1, wherein the propulsion fin further has a right side with a right lip disposed downward and adapted to at least partially contact the surface of the liquid in which the device is adapted to float, and a left side with a left lip disposed downward and adapted to at least partially contact the surface of the liquid in which the device is adapted to float.

6. The method of claim 5, wherein the left lip and right lip are adapted to direct water rearward as the fin oscillates downward.

7. The method of claim 6, wherein the left lip and right lip have one or more slits in each lip thereby increasing the flexibility of the propulsion fin.

8. The method of claim 1 further providing the propulsion fin with a generally planar top side, said top side of the fin being shaped like a regular trapezoid with the base (B1) being at the proximal end of the fin and a truncated top (T1) of the trapezoid being at the distal end of the fin.

9. The method of claim 1 further providing the propulsion fin with a generally rectangular planar top side, and left and right lips being wider at the distal end of the fin.

10. The method of claim 1 further providing the propulsion fin with a generally trapezoidal planar top side, and left and right lips, said left and right lips being narrower at the distal end of the fin and widening therefrom.

11. The method of claim 1 further providing the propulsion fin with a generally "U" shape profile with a curved top and left and right downwardly disposed lips.

12. The method of claim 1 further providing the propulsion fin with a generally trapezoidal top side, said trapezoidal top side being concave downward, said fin further including left and right lips being narrower at the distal end of the fin.

13. The method of claim 1 further providing the propulsion fin with a generally planar top side, said top side of the fin being shaped like a trapezoid having a base width (B1) and a narrower top width (T1), and said extension member having a width (E1) measured where the extension member is connected to the base of the trapezoidal shaped fin, said extension member width (E1) being less than a width (B1) of the base of the trapezoid, thereby forming a flex axis located where the extension member is connected to the base of the trapezoidal shaped fin.

14. The method of claim 1 further providing the flotation member with a top surface; a bottom surface, and wherein the recess is accessible from the bottom surface of the flotation member.

15. The method of claim 1 further providing the flotation member with a top surface; a bottom surface, and wherein the recess is accessible from the top surface of the flotation member.

16. A vibration-powered device adapted for flotation and propulsion on an upper surface in a liquid, said device comprising:

a body having an internal water-resistant cavity and an external surface, the body further having a longitudinal axis, a front end portion and a rear end portion, a top side and a bottom side;

a vibration mechanism disposed within the internal water resistant cavity;

a propulsion fin, said fin having a proximal end connected to the body, said fin having a free distal end opposite the proximal end, said fin having a top side adapted to be disposed at least partially above the surface of the liquid, said fin having a bottom side adapted to be disposed at least partially below the surface of the liquid;

wherein said vibration mechanism when actuated is configured to oscillate the free distal end of the propulsion fin upward and downward; and a flotation member having a recess configured to directly secure to a portion of the external surface of the body, the flotation member having a shape configured to substantially maintain a portion of the top side of the body above the surface of the liquid and further configured to substantially maintain a portion of the bottom side of the body below the surface of the liquid when the flotation member is secured to the portion of the external surface of the body.

17. The vibration-powered device of claim 16, wherein the flotation member includes: a top surface; a bottom surface; and wherein the recess is accessible from the bottom surface of the flotation member.

18. The vibration-powered device of claim 16, wherein the flotation member includes: a top surface; a bottom surface; and wherein the recess is accessible from the top surface of the flotation member.

19. The vibration-powered device of claim 16, wherein the vibration mechanism is adapted to oscillate the free distal end of the propulsion fin by flexing of the fin at a flex axis in an upward and downward flexure movement of the free distal end relative to the flex axis.

20. The vibration-powered device of claim 16, wherein the vibration mechanism is a vibration-powered toy vehicle adapted for moving on land.

* * * * *